US012553689B2

(12) United States Patent
Citron

(10) Patent No.: US 12,553,689 B2
(45) Date of Patent: Feb. 17, 2026

(54) COMPENSATING FOR PROJECTILE WEIGHT IN BALLISTICS

(71) Applicant: Mannis Operations LLC, Jupiter, FL (US)

(72) Inventor: Jeffrey Citron, Jupiter, FL (US)

(73) Assignee: Mannis Operations LLC, Jupiter, FL (US)

( * ) Notice: Subject to any disclaimer, the term of this patent is extended or adjusted under 35 U.S.C. 154(b) by 150 days.

(21) Appl. No.: 18/385,341

(22) Filed: Oct. 30, 2023

(65) Prior Publication Data

US 2025/0137752 A1 May 1, 2025

(51) Int. Cl.
*F41G 3/12* (2006.01)
*F41G 3/26* (2006.01)

(52) U.S. Cl.
CPC *F41G 3/12* (2013.01); *F41G 3/26* (2013.01)

(58) Field of Classification Search
CPC ..... F41G 3/26; F41G 3/00; F41G 3/06
USPC ..... 235/404, 400, 417
See application file for complete search history.

(56) References Cited

U.S. PATENT DOCUMENTS

| | | | | |
|---|---|---|---|---|
| 3,143,919 | A | 8/1964 | Estes | |
| 3,363,296 | A | 1/1968 | Duffield | |
| 3,440,923 | A | 4/1969 | Purdie | |
| 3,705,515 | A | 12/1972 | Lee | |
| 4,723,472 | A | 2/1988 | Lee | |
| 4,836,078 | A | 6/1989 | Lee | |
| 5,635,661 | A | 6/1997 | Tuftee | |
| 5,649,465 | A | 7/1997 | Beebe | |
| 6,050,169 | A | 4/2000 | Voros | |
| 6,397,720 | B1 | 6/2002 | Fox et al. | |
| 9,395,155 | B1 | 7/2016 | Bockmon | |
| 9,464,871 | B2 | 10/2016 | Bay | |
| 9,574,860 | B1 | 2/2017 | Mobley | |
| 10,794,676 | B1 | 10/2020 | Aerni | |
| 11,067,375 | B1 | 7/2021 | Helgason | |
| 11,333,473 | B2 | 5/2022 | Carper et al. | |
| 2006/0177104 | A1* | 8/2006 | Prokoski | G06T 7/0002 382/181 |
| 2009/0266892 | A1* | 10/2009 | Windauer | F41G 3/06 235/404 |
| 2011/0114725 | A1 | 5/2011 | Young | |
| 2012/0160081 | A1 | 6/2012 | Beebe | |
| 2014/0110482 | A1* | 4/2014 | Bay | F41G 1/44 235/404 |
| 2014/0268187 | A1* | 9/2014 | Nichols | G06T 11/206 345/440 |
| 2016/0084617 | A1 | 3/2016 | Lyren | |
| 2017/0138712 | A1* | 5/2017 | Teig | F42B 33/001 |
| 2017/0205197 | A1* | 7/2017 | Sammut | F41G 3/08 |

(Continued)

FOREIGN PATENT DOCUMENTS

| | | | |
|---|---|---|---|
| WO | 9736701 | A1 | 10/1997 |
| WO | 2019161053 | A2 | 8/2019 |
| WO | 2023057040 | A1 | 4/2023 |

*Primary Examiner* — Edwyn Labaze
(74) *Attorney, Agent, or Firm* — Davis Wright Tremaine LLP

(57) ABSTRACT

An apparatus, system, computer-readable medium, and/or process to measure, sense, or otherwise obtain weight of a projectile and use that information to generate instructions to adjust aim of the projectile. For example, instructions may indicate a desired weight of a projectile for performance.

21 Claims, 6 Drawing Sheets

(56) References Cited

U.S. PATENT DOCUMENTS

| | | | |
|---|---|---|---|
| 2020/0056870 | A1 | 2/2020 | Carper et al. |
| 2022/0349676 | A1 | 11/2022 | Maguire |

* cited by examiner

COMPENSATING FOR PROJECTILE WEIGHT IN BALLISTICS

CROSS-REFERENCE TO RELATED APPLICATIONS

This application incorporates by reference for all purposes the full disclosure of co-pending U.S. patent application Ser. No. 18/385,336, filed Oct. 30, 2023, entitled "MODIFYING A PROJECTILE CASING" and co-pending U.S. patent application Ser. No. 18/385,339, filed Oct. 30, 2023, entitled "COMPENSATING FOR TEMPERATURE OF A BARREL IN BALLISTICS."

TECHNICAL FIELD

The embodiments of the disclosure relate to compensating for a weight of a projectile, which can impact how projectiles are affected in the shooting process. Specifically, the disclosed includes a system, method, apparatus, and computer-readable medium that causes a system to generate instructions for a user (e.g., marksman) to adjust their aim of a projectile based, at least in part, on a weight of the projectile.

BACKGROUND

Ballistics includes the science of projectiles and firearms, such as the motion of objects (e.g., rounds of projectiles) that are driven forward. For example, ballistics includes the study of effects of firing a round for a projectile, where the round comprises a cartridge including a casing and the projectile (e.g., bullet, slug, or shot). There are many factors to consider when a firearm fires a projectile according to ballistics. For example, the muzzle velocity (e.g., exit speed) of the bullet from a barrel, the shape of the bullet, the size of the bullet, and the material of the bullet can affect the round's trajectory. Also, properties of the barrel such as length, material, width, and design can affect the firing of a round, impacting the result. These are various factors a marksman can consider while aiming. However, a marksman can still consider these factors and have performance affected (e.g., missing a target, having less accuracy and/or consistency), as there are many factors to consider when firing a projectile. Accordingly, there exists a need to improve firing a round of a projectile.

DETAILED DESCRIPTION

Figure 1:
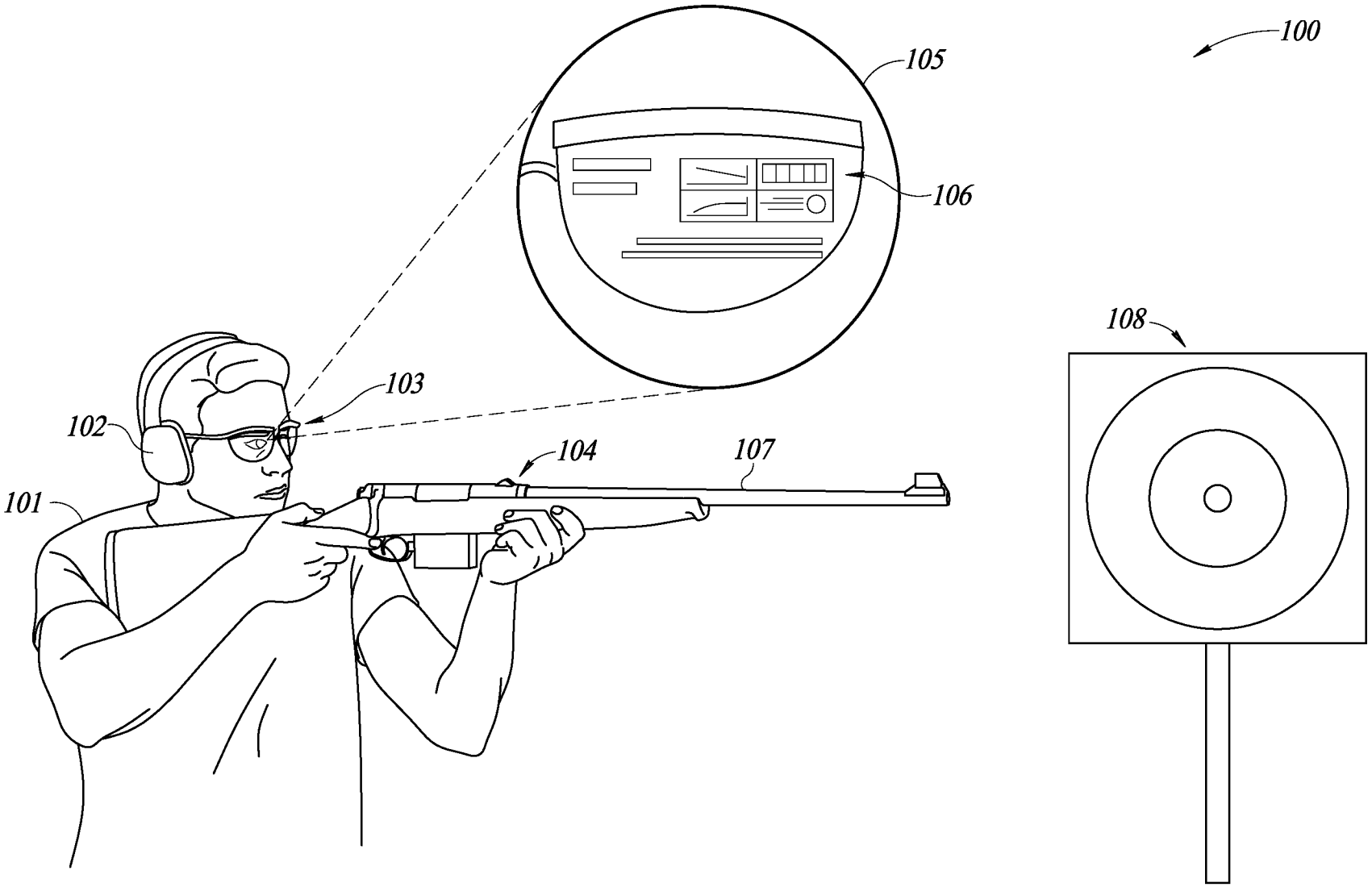
FIG. 1 illustrates a schematic diagram for adjusting the position and/or aim of a projectile based, at least in part, on a weight of the projectile, in accordance with at least one embodiment.

Firing (e.g., igniting) a round of a projectile may be caused by a firing pin striking a primer of a cartridge. Pressure from the gas released from a primer igniting the powder may then cause the projectile to travel through and exit the barrel. A cartridge may comprise a case, primer (e.g., rimfire or centerfire), powder, and a projectile (e.g., bullet, slug, and/or shot). A bullet's shape and weight can affect how it moves down the gun barrel, which can affect its exit velocity from the gun. While all bullets are subject to gravity, a heavy bullet generally indicates that it has more weight that is distributed around the bullet. For example, if two bullets from the same manufacturer having the same perceived shape (e.g., the same size), but one bullet is heavy, the heavy bullet can have more material on its edges, which can create additional friction in the barrel and drag in the air. Furthermore, if one is accounting for environmental conditions when aiming, a heavier projectile will take more force from wind to veer outside of its trajectory than a lighter projectile. As another example, if a bullet has a slightly different shape compared to a standard bullet (e.g., more curve or more imperfections), the difference may not be easily visible and difficult to calculate. However, this difference (though not easily seen) may result in a difference in weight of the bullet, where a measurement of the weight can indicate whether the bullet is a standard or not-standard shape, which may impact the bullet's trajectory.

In particular, a bullet's weight can affect a bullet's ballistic coefficient and/or indicate a shape of a varying ballistic coefficient. In at least one embodiment, ballistic coefficient is a measure of external ballistic performance for bullets. The higher a bullet's ballistic coefficient is, the less drop and wind deflection it will have at all ranges for a given muzzle velocity and environment. A ballistics coefficient is a number that can be used as an input for ballistic solvers to predict trajectories, but in general weight of a bullet has not been considered in ballistics bullet calculations. In at least one embodiment, a weight of a bullet can be used by a neural network, correlation table, or other software as an indicated of weight distribution, aerodynamics, drag force, and/or shape of the bullet. For example, a small increase (e.g., 1-10 grams) of a bullet can cause the bullet to have a larger diameter, a different shape, or other physical property that affects how it moves through a barrel (e.g., more or less friction depending on its weight distribution and shape, more or less drag depending on its weight distribution). In at least on embodiment, weight distribution includes how weight is disturbed in a bullet (e.g., it can written in the form x/y, where x is the percentage of weight in a front section, and y is a percentage in the back).

In at least one embodiment, a weight of a bullet affects its velocity, trajectory, and other properties when it is shot. For example, a weight can affect velocity, ballistic coefficient, stability, energy, wind drift, recoil, and barrel wear. In at least one embodiment, weight affects velocity because heavier bullets generally have a lower muzzle velocity than lighter bullets when fired from the same firearm, because they require more energy to move. A lower velocity means the bullet will drop more over a given distance, affecting its trajectory. In at least one embodiment, weight affects ballistic coefficient (e.g., a measure of a projectile's ability to overcome air resistance in flight). For example, heavier bullets typically have higher ballistic coefficients, meaning they are less affected by wind and retain their velocity better than lighter bullets, which can result in a flatter trajectory over long distances. In at least one embodiment, bullet weight can affect stability. Stability of a bullet in flight can be influenced by its weight and shape. A bullet must be properly stabilized to maintain an accurate trajectory. If a bullet is too light or the barrel twist rate is too slow, the bullet may tumble in flight, leading to erratic trajectories. In at least one embodiment, bullet weight can affect energy. For example, heavier bullets can carry more energy than lighter bullets at the same velocity, which can mean that they can potentially penetrate targets more effectively, but this additional energy also means that they can be more affected by gravity and may drop more quickly than lighter bullets. In at least one embodiment, bullet weight can affect wind drift. For example, heavier bullets are generally less affected by crosswinds than lighter bullets, leading to a straighter trajectory in windy conditions. In at least one embodiment, weight of a bullet can affect recoil. For example, heavier bullets generally produce more recoil when fired, which can affect the shooter's ability to maintain a consistent aim and follow through, potentially affecting the trajectory. In at least one embodiment, bullet weight can affect barrel wear. For example, heavier bullets can cause more wear on a gun barrel over time, potentially affecting the barrel's characteristics and, by extension, the bullet's trajectory. In at least one embodiment, bullet weight can affect many factors when firing a gun. For example, while a heavier bullet may have a lower initial velocity and more drop over short distances, its higher ballistic coefficient can lead to a flatter trajectory and less wind drift over longer distances, compared to a lighter bullet.

In at least one embodiment, the disclosed technology apparatus, system, computer-readable medium, and/or process includes determining a weight of a projectile; determining an adjustment for a gun aiming at a target based, at least in part, on the projectile's weight; and providing instructions to a user device that indicate how to modify aim of the projectile based, at least in part, on the determined adjustment. For example, a marksman can weigh all bullets before inserting them into cartridges; and these weights can be provided to a processor (e.g., central processing unit (CPU), graphics processing unit (GPU), application specific processing circuit (ASIC)); and the processor uses these weights to generate instructions for adjusting the aim of a gun when firing these projectiles.

Example embodiments are described herein with reference to the accompanying drawings. The figures are not necessarily drawn to scale. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open-ended in that an item or items following any one of these words is not meant to be an exhaustive listing of such item or items or meant to be limited to only the listed item or items. It should also be noted that as used herein and in the appended claims, the singular forms "a," "an," and "the," include plural references unless the context clearly dictates otherwise. In at least one embodiment, based on includes based, at least in part, on.

In the following description, various working examples are provided for illustrative purposes. However, is to be understood the present disclosure may be practiced without one or more of these details. Reference will now be made in detail to non-limiting examples of this disclosure, examples of which are illustrated in the accompanying drawings. The examples are described below by referring to the drawings, wherein like reference numerals refer to like elements. When similar reference numerals are shown, corresponding description(s) are not repeated, and the interested reader is referred to the previously discussed figure(s) for a description of the like element(s).

In at least one embodiment, the disclosed technology can be used for cartridges designed for different types of projectiles, such as those fired by a gun (e.g., of a particular caliber or gauge). In at least one embodiment, guns may fire projectile cartridges for artillery. A type of gun can impact ballistics associated with firing a bullet. A gun can be any type of firearm used by an individual, such as a handgun (e.g., pistol), shotgun (e.g., slugs or shot), or rifle (semi-automatic or automatic). A gun may also include crew-served equipment to fire a projectile from a barrel, such as artillery or naval guns. In some embodiments, the disclosed technology works with guns (e.g., rifles) used for precision shooting (e.g., long range), e.g., long-rang precision rifle shooting. For example, the disclosed technology can be used with .22 long rifle, Blaster R8, Remington Model 770, CMMG MK47 Mutant, Colt C-19, Bergara B-14 BMP, Savage Model 10 GRS, Howa HCR, Proof Glacier Ti, Accuracy International AXSR, Seekins Havak Pro Hunter 2, Mauser M18, Sako TRG 22 A1, Mossberg Patriot LR Tactical, Accuracy International AT-X, Tikka T3X UPR, Seekins Havak HIT, Christensen Arms MPR, Daniel Defense Delta 5, and/or other long-range rifle for precision shooting. In at least one embodiment, the disclosed technology uses or otherwise includes ammunition such 223 Remington, 5.5 NATO, .224 Valkyrie, 6.5 Grendel, 6 mm Creedmoor, 6.5 Creedmoor, .308 Winchester, self-loaded cartridges, or other cartridges used with long-range rifles. Projectile weight may be calculated to predict a projectile's trajectory over a distance, which may be generated by a type of gun, the cartridge used (e.g., an amount of powder and/or size of projectile), and/or the manufacturer. Instructions to a marksman may also include a prediction of a projectile's trajectory based, at least in part, on a projectile's weight indicating a change to its surface area (which may impact its ballistic coefficient).

FIG. 1 illustrates a schematic diagram for adjusting the position and/or aim of a projectile based, at least in part, on a weight of the projectile, in accordance with at least one embodiment. FIG. 1 includes a shooting environment 100 and a marksman 101 aiming a gun 102 with a gun barrel 107. FIG. 1 also includes marksman 101 wearing glasses 103 that can display information 104 on a lens as shown by graphical user interface 105. The information 104 can include instructions for aiming a gun based, at least in part, on a weight of a projectile. For example, information 104 can include information for adjusting sight alignment, location of the gun barrel, location of the gun, adjusting sight zero (e.g., MOA), and/or instructions for repositioning the gun barrel a particular amount. A system, processor, or other means disclosed in FIGS. 2, 3, 4, 5, 6, and 7 can generate the information 104. In at least one embodiment, headphones 106 can generate audio instructions with information 104 such that a marksman (e.g., shooter) can hear instructions for aiming.

In at least one embodiment, the disclosed technology apparatus, system, computer-readable medium, and/or process includes instruction to a marksman to adjust aim of a gun based on minute of angle (MOA), which correlates to the minute hand of a 360-degree clock face, where each minute refers to 1/60th of a degree, similar to the minutes of an hour. MOA may be used to calculate group size at a target some distance (e.g., yards, feet), such as 1 MOA is a 1" circle at 100 yards (e.g., 3" at 300 yards). When adjusting sights (e.g., telescopic and/or open) for a distance, the MOA may be calculated to know how many clicks (e.g., 1 click=¼ MOA) adjusting a scope are needed to move sights an inch, such as shots grouped at a distance at 100 yards would need 4 clicks to adjust 1." A process may then calculate an expected ballistic coefficient for a round based, at least in part, on a weight of a projectile and then predict an MOA needed to adjust a group of shots for a distance (e.g., 300 yards).

In at least one embodiment, a prediction is generated for a ballistic coefficient based, at least in part, on previously recorded results of projectiles at a same weight (e.g., grains). For example, two bullets of a same weight by an identified manufacturer may have a distribution of material is similar, which indicates a similar ballistic coefficients for each bullet. Previous trajectories measured (e.g., by a manufacturer or using live data of a marksman) may be recorded and a neural network uses a prediction algorithm, clustering similar results based on weight and generating a prediction. Projectile information used may include manufacturer, batch, lot, grain, and/or size (e.g., caliber or gauge). In at least one embodiment, a manufacturer sets up a lab with a known target, known gun type, known distance between gun and target, known weight of bullets (e.g., based on scale measurements), and other known variable values (e.g., temperature, wind). Using this known information, the manufacturer fires many rounds (e.g., hundreds, thousands, millions) of bullets with these known conditions, records these results (e.g., where on the target the bullets hits), and labels this data as results data such that it can be used to train a neural network to learn to predict how weight of projectiles affects trajectory or accuracy.

Aiming a projectile may often take many considerations and, then as distance increases between a marksman 101 and a desired target 108, these conditions may impact the result more significantly. For example, a group of shots may be 1" in diameter at 100 yards and 3" in diameter at 300 yards when introducing the same amount of movement of the marksman, holding other factors constant. Marksman, when training to fire a projectile, may often find a dilemma of whether it is their equipment (e.g., projectile weight, cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing). As these variables can be exacerbated over longer distances, controlling (e.g., isolating) a variable can improve performance and/or affirm that performance is being consistent. In at least one embodiment, glasses 103 may display information to include biometrics, environmental conditions, and/or equipment information (e.g., projectile weight, temperature measurements, image of target, prior outcomes) shown by a graphical user interface 105, such as to predict a desired aim for a target (e.g., MOA needed to adjust sights to aim directly through sight) based, at least in part, on a projectile's weight. In at least one embodiment, a neural network performs self-supervised training by receiving data of a projectile weight, generating a prediction of a trajectory, receiving an outcome of the projectile, calculating loss from prediction, and updating one or more neural network parameters. In at least one embodiment, a processor trains a neural network based, at least in part, on labeled training data with projectile weights, aim locations, gun types, and target hit information. Then a neural network may learn from one or more marked weights target information (e.g., where is the center of a target and/or a group, preferred locations of a group, and/or sight adjustments needed to correct said group). In at least one embodiment, a neural network is trained to optimize precision and/or accuracy of a projectile.

The information 104 can include instructions for aiming a gun based, at least in part, on weight of a projectile (e.g., indicating a ballistic coefficient), temperature measurements of a gun barrel, predicted ballistic coefficient, and/or previous outcomes of a projectile of a same weight. For example, information 104 can include information for adjusting sight alignment, location of the gun barrel, location of the gun, and/or instructions for positioning a gun or sights (e.g., MOA and/or sight clicks) a particular amount. A system, processor, or other means disclosed in FIGS. 2, 3, 4, 5, 6, and 7 can generate the information 104. In at least one embodiment, headphones 106 (e.g., sound canceling ear protection with audio) can generate audio instructions with information 104 such that a marksman can hear instructions for aiming.

In at least one embodiment, a system includes a collection of one or more hardware and/or software computing resources with instructions that, when executed, performs one or more communication processes such as those described herein. In at least one embodiment, system 100 is a software program executing on computer hardware, an application executing on computer hardware, and/or variations thereof. In at least one embodiment, one or more processes of system are performed by any suitable processing system or unit (e.g., graphics processing unit (GPU), general-purpose GPU (GPGPU), parallel processing unit (PPU), central processing unit (CPU)), a data processing unit (DPU), such as described below, and in any suitable manner, including sequential, parallel, and/or variations thereof.) In at least one embodiment, system 100 uses a machine learning training framework, such as PYTORCH, TENSORFLOW, BOOST, CAFFE, MICROSOFT COGNITIVE TOOLKIT/CNTK, MXNET, CHAINER, KERAS, DEEPLEARNING4J, and/or other training framework to implement and perform operations described herein to predict a trajectory, modify aim of a projectile, and/or otherwise perform operations described herein. In at least one embodiment, as an example, training a neural network model comprises use of a server which further includes at least a GPU (e.g., AMD MI200, VEGAL10, VEGO20, and ARCTURUS), an optimizer (e.g., ADAM OPTIMIZER), or discriminator architecture. For example, a neural network to modify aim of a projectile includes a convolution neural network (CNN), transformer neural network, diffusion model, transducer, recurrent, and/or attention-based neural networks.

In at least one embodiment, a system provides instructions using information 104 to modify the aim of a barrel based, at least in part, on the projectile's weight. This provided modification may occur live, when invoked (e.g., user initiated, such as by pressing a button), between one or more shots, and/or between a series of shots. Identifying the aim, such that user instructions of an adjustment may be provided, may occur using one or more of the described method. A first method may include identifying the aim of a barrel, which may occur through a sensor attached to the end of the barrel and a sensor on the desired target, such that trajectory is measured. This may provide for live updates and recommended adjustments. A second method may include identifying a target and/or your position through a global positioning system (GPS), then uploading (e.g., manually through an image of the target and/or a sensor and/or laser returning results of each shot to a device) results to an application, such that instructions are available between each shot or series of shots. A third method may include selecting through a mapping system (e.g., GPS) the location of your location and the target, from which the distance and the trajectory may be calculated. A fourth method may include using a range finder in combination with returned results from a target (e.g., manual upload through image and/or sensors determining shot location). A fifth method may include a set of glasses with a range finder, where a user may invoke (e.g., through pushing a button, such as on the frame of the glasses) a target with a sensor being at a set location, then based, at least in part, on previous results, it may return instructions for subsequent shots. Methods described may then apply physics equations such as physics trajectory based, at least in part, on the target result and position of the marksman. Using this trajectory and manufacturer information from a result, information pertaining to the trajectory and velocity can be calculated. Methods described may be used in combination with laser target systems (e.g., SCATT). Furthermore, an option may include, when a rifle includes a dry firing option that would not damage the gun, to simulate firing a shot.

Figure 2:
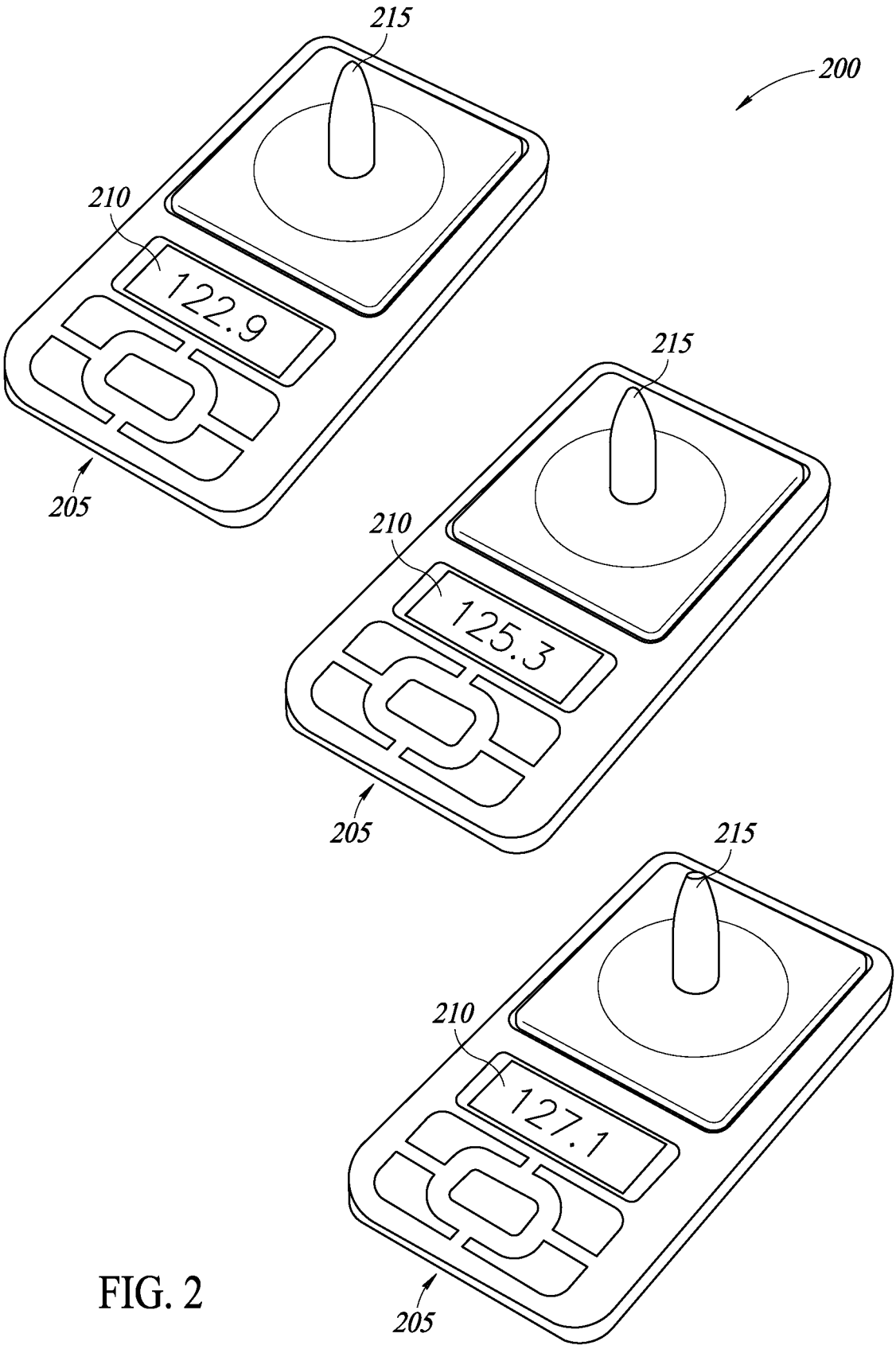
FIG. 2 illustrates a system for weighing a projectile to collect projectile information, in accordance with at least one embodiment.

FIG. 2 illustrates a system for weighing a projectile to collect projectile information, in accordance with at least one embodiment. FIG. 2 includes weight environment 200 with three scales 205 each with a display 210 for a weight value, and three different bullets 215. In at least one embodiment, weights are measured by manufacturers and input into a user interface and/or application. In at least one embodiment, weights are measured by a marksman and input into a user interface and/or application.

Projectile information to include projectile weight and previous trajectory outcomes may be stored as a data structure. For example, trajectory information be calculated using an optical sensor and/or laser to collect data of a trajectory. A trajectory may also be back calculated from the result of a projectile's impact. In at least one embodiment, a neural network uses a data structure to predict a projectile's trajectory based, at least in part, on a projectile's weight. A projectile weight may indicate a ballistic coefficient (e.g., a variation in surface area affecting drag). Weighing one or more projectiles may allow for a marksman to determine a weight of a projectile best suited for their gun and/or predict a trajectory when using projectiles of varying weight. In at least one embodiment, identification information may be placed on a cartridge indicating a projectile's weight. In at least one embodiment, a neural network may use an image of a projectile to predict a projectile's weight and/or ballistic coefficient. In at least one embodiment, a neural network performs self-supervised training by receiving data of a projectile weight, generating a prediction of a trajectory, receiving an outcome of the projectile, calculating loss from prediction, and updating one or more neural network parameters. In at least one embodiment, a neural network is provided with density information for type of bullet (e.g., metal composition and shape) as training data to learn how to predict a weight of bullets. In at least one embodiment, training data of labeled bullets and their respective weights are provided to a neural network. In at least one embodiment, a marksman can take a picture of several bullets or a single bullet using a mobile computing device and provide this picture (e.g., images) to a neural network that predicts how weight will affects its trajectory.

Figure 3:
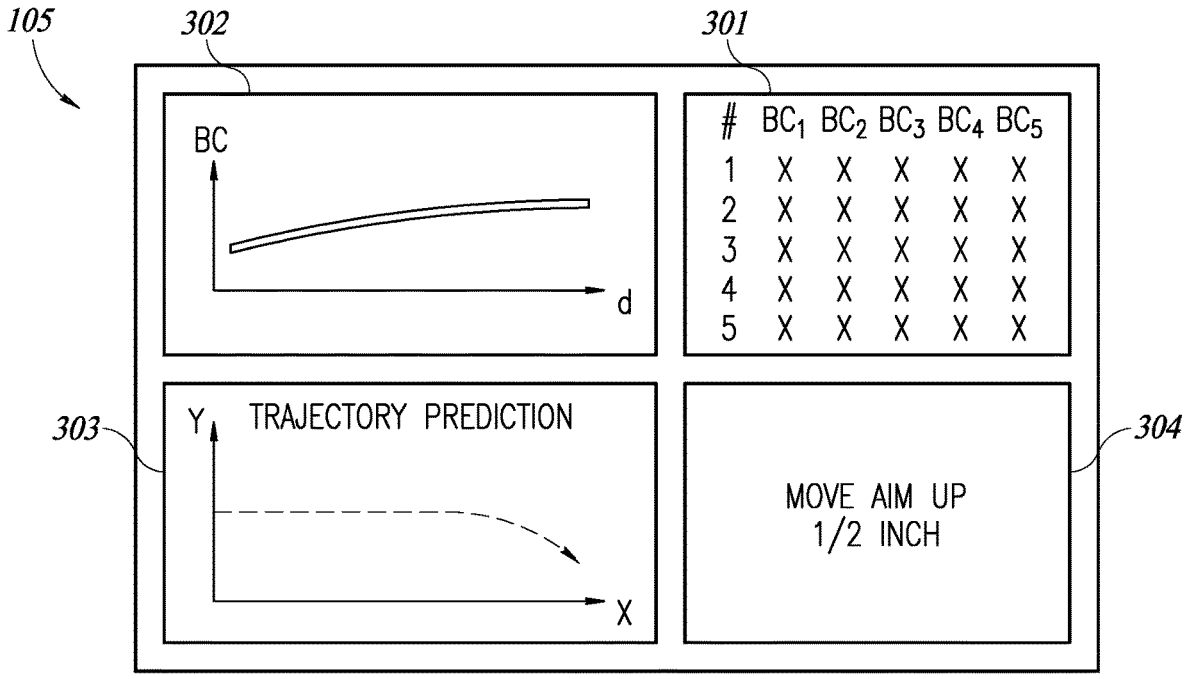
FIG. 3 illustrates a graphical user interface for providing information to a user regarding a projectile in accordance with at least one embodiment.

FIG. 3 illustrates a graphical user interface 105 for providing information to a user regarding a projectile in accordance with at least one embodiment. A computing device such as computing device 404 in FIG. 4, glasses with a processor, or other computing device can generate graphical user interface 105. A device can display graphical user interface 105 on a screen, on lens of glasses, or other visible user interface. Graphical user interface 105 can be integrated into shooting environment 100 in FIG. 1 to help a marksman adjust aiming using a gun barrel such as gun barrel 107 in FIG. 1. A device performing or using process 505 (FIG. 5) and/or process 600 (FIG. 6) can display or generate graphical user interface 105. Graphical user interface may acquire a distance (e.g., yardage) of a target by user input, GPS, Bluetooth, and/or a laser (e.g., range finder). Graphical user interface 105 can display one message at a time (e.g., "MOA is 3 inches for 300 yards," "aim lower by ½ inch," or "aim lower 1 minute of angle").

In the upper left 302 of graphical user interface 105, a graph illustrates how weight affects trajectory of bullets. For example, weight may act as an indication of surface area of a projectile and/or if there are any manufacturer deviations. Visually, it may be challenging to distinguish a manufacturer deviation (e.g., slight more metal, different distribution of shape, leftover metal from bullet mold). Weight may act as an indication of such deviations. In at least one embodiment, graphical user interface 105 generates a trajectory for a bullet based, at least in part on, how weight can affect velocity, ballistic coefficient, stability, energy, wind drift, recoil, and barrel wear. For example, wind drift information can be provided to a shooter or based on weather conditions, and barrel wear can be based on how many times a gun was fired and with what type of bullets.

In the upper right 301 of graphical user interface 105, a table illustrates weight (e.g., grains) of a projectile, and the round's predicted and/or previous performance (e.g., the trajectory and previous target outcomes). The information displayed in the upper right of graphical user interface 105 can be used by a marksman to adjust their aim. For example, a marksman may observe that for a rifle, a grain in the 48th percentile for a caliber may result in a smaller grouping size than a grain in the 60th percentile, which may indicate a deviation in the projectile's profile (e.g., flashing) and correspond to a different surface area and/or ballistic coefficient. As an example (e.g., with illustrative values, a table may include weights of a projectile:

| Shot Number | Projectile ID (Caliber) | Weight (grams) | Weight Percentile | Distance From Center of Group at 100 yards |
|---|---|---|---|---|
| 1 | .308 | 11.92 | 50 | 1.00" |
| 2 | .308 | 12.10 | 55 | 1.08" |
| 3 | .308 | 11.75 | 25 | .92" |
| 4 | .308 | 12.51 | 75 | 1.40" |
| 6 | .308 | 13.02 | 92 | 1.6" |
| 7 | .308 | 11.84 | 48 | .99" |
| 8 | .308 | 11.92 | 50 | 1.00" |

As another example, a marksman may observe different types of manufactured rifles, when firing a same caliber, may perform better with different grain bullets (e.g., 55.3, 55.8, 55.9). In at least one embodiment, rather than using a specific lot of bullets when performing precision marksmanship, a marksman may instead use a desired grain indicated by a neural network rather than being constricted to a specific lot.

In the bottom left 303 of FIG. 3, the graphical user interface 105 displays a predicted trajectory of a projectile based on weight of the projectile. For example, if the projectile has a greater weight outside of a 90th percentile for a manufacturer, the graphical user interface may indicate that bullet will travel a lower, varying trajectory over a distance (e.g., accounting for the environment like wind), and/or recommend discarding the bullet. As another example, if a first bullet is of a 48th percentile for weight (e.g., 50-51 grains) and a second bullet is of a $52^{nd}$ (e.g., 56-57 grains) percentile, these round's performance may be accumulated separately to determine which is a preferred bullet weight for the manufacturer's type of round and specific rifle being used.

In bottom right of FIG. 3, graphical user interface 105 includes instructions 304 for a marksman. Specifically, a device, such as computer device 404, generates a graphical user interface 105 which may indicate to a marksman a predicted trajectory for a weight of a projectile. For example, graphical user interface 105 may display information and/or instructions based, at least in part, on equipment information (e.g., projectile weight, cartridge to include projectile size and/or amount of charge, rifle design, trigger mechanics, sight), environmental conditions (e.g., wind, moisture, correct distance calculations attributing for altitude, distance from target, and/or temperature) and/or biometrics (e.g., heart rate, shot approach, and/or breathing), such as to predict a desired aim for a target (e.g., MOA needed to adjust sights to aim directly through sight). For example, graphical user interface 105 can include instructions 304 such as "move aim up ½ inch" to indicate to a marksman to move their aim up ½ an inch. Other examples of instructions can include "stop" shooting (e.g., because aim not close) or an indication of how weight may affect bullets when fired (e.g., "these bullets are heavier than average," which is an indication to aim differently or "these bullets are lighter than average," which is an indication to aim differently," or "the higher than normal weight of these bullets will increase the ballistics coefficients for this next shot.").

Figure 4:
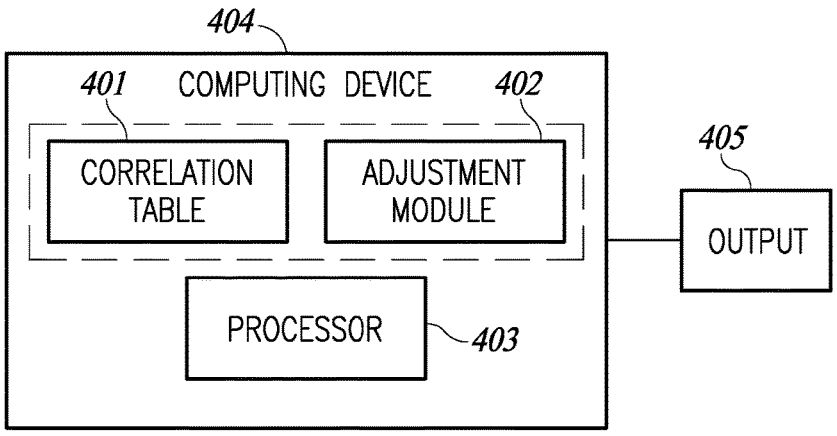
FIG. 4 illustrates a system for adjusting aim of a projectile based, at least in part, on the weight of a projectile, in accordance with at least one embodiment.

FIG. 4 illustrates a system for adjusting aim of a projectile based, at least in part, on the weight of a projectile, in accordance with at least one embodiment. FIG. 4 includes computing device 404, which can generate an output 405 (e.g., instructions for a shooter, warnings for a shooter, temperature profiles). Computing device 404 can include a correlation table 401, an adjustment module 402, and a processor 403. Processor 403 can receive weights of bullets and use correlation table 401 and/or adjustment module 402 to generate instructions for a shooter. In at least one embodiment, processor 403 includes a circuit or logic to perform, use, or other implement correlation table 401 and/or adjustment module 402. In at least one embodiment, a circuit or logic can include a graphics processing unit, data processing unit, a central processing unit, and/or application specific integrated circuit. In at least one embodiment, processor 403 can include processor cores dedicated to performing correlation table 401 and/or adjustment module 402. In at least one embodiment, processor 403 can use computer code that is structured to provide correlation table 401 and/or adjustment module 402 to processor 403.

Correlation table 401 is software, which when performed by a processor, can correlate temperature and aim values. For example, a correlation table 401 can include information about a manufacturer, rifle information, and/or projectile information (e.g., projectile results, projectile weight, caliber, charge used, type of primer). Projectile results may include results returned form a target (e.g., SCATT), an image of shots with respect to a target, lack of shots on a target, and/or shots with respect to a group and/or a center of a target. As an example, a result may be distance from the center of a target and/or group. As another example, projectile results may also be a score relative to the distance from the center of a target. Projectile results can also correspond to shooting conditions, (e.g., weather, shooter, gun used, number of bullets shot, number of casings used, and/or other information collected before, during, or after the gun was fired and the results were observed.) Correlation table may also include their equipment information (e.g., cartridge to include projectile size and/or amount of charge, barrel information, rifle design, trigger mechanics, sight), environmental conditions (e.g., temperature, wind, moisture, correct distance calculations attributing for altitude, and/or temperature) and/or biometrics (e.g., muscle fatigue prediction such as time to fire from a position, desired time while aiming, position to fire from, heart rate, shot approach, and/or breathing). In at least one embodiment, correlation table 401 can include information for In at least one embodiment, graphical user interface 105 generates a trajectory for a bullet based, at least in part on, how weight can affect velocity, ballistic coefficient, stability, energy, wind drift, recoil, and barrel wear. For example, wind drift information can be provided to a shooter or based on weather conditions, and barrel wear can be based on how many times a gun was fired and with what type of bullets.

Adjustment module 402 is software, which when performed by a processor, can a generate instructions for making adjustments to a gun based on a weight of a projectile. Adjustment module 402 can include a neural network that receives weight of a projectile (e.g., grain), temperature readings, gun type, barrel properties, projectile information, and/or other conditions (e.g., environmental, biometric, and/or equipment information) for aiming and firing a gun, then outputs a suggested aim adjustment (e.g., a predicted MOA). Adjustment module 402 can determine where a marksman is currently aiming (e.g., based on location of gun, video of person shooting the gun, crosshairs of gun, motion detectors on gun, laser sensors at target and laser on gun) and generate instructions for adjusting aim. For example, adjustment module 402 may be used in connection with an IR laser or camera based shooting training system (e.g., SCATT).

Processor 403 can execute computer-executable instructions, non-transitory computer-readable instructions, or machine-readable instructions. Processor 403 can constitute any physical device or group of devices having electric circuitry that performs a logic operation on an input or inputs. For example, processor 403 can include one or more integrated circuits (IC), including application-specific integrated circuit (ASIC), microchips, microcontrollers, microprocessors, all or part of a central processing unit (CPU), graphics processing unit (GPU), digital signal processor (DSP), field-programmable gate array (FPGA), server, virtual server, or other circuits suitable for executing instructions or performing logic operations. The instructions executed by processor 403, for example, may be pre-loaded into a memory integrated with or embedded into the controller or may be stored in a separate memory. Processor 403 can be separate circuits or integrated in a single circuit. Processor 403 can be configured to operate independently or collaboratively. Processor 403 can be coupled electrically, magnetically, optically, acoustically, mechanically, or by other means that permit it to interact with computer device 404 or other processing units. In at least one embodiment, processor 403 can use application programming interfaces (APIs) to perform operations or receive information related to ballistics (e.g., gun barrel information, temperature barrel information, correlation information).

Processor 403 can access, use, or otherwise communicate with volatile memory (e.g., registers, cache, RAM), non-volatile memory (e.g., ROM, EEPROM, flash memory), or some combination of the two. Memory can store software (e.g., correlation table 401, adjustment module 402) for implementing one or more of the described embodiments. For example, memory may store correlation table 401, adjustment module 402 for implementing any of the disclosed techniques described herein and their accompanying user interfaces. Memory can include any mechanism for storing electronic data or instructions, including Random Access Memory (RAM), a Read-Only Memory (ROM), a hard disk, an optical disk, a magnetic medium, a flash memory, other permanent, fixed, volatile or non-volatile memory. Memory can include one or more separate storage devices collocated or disbursed, capable of storing data structures, instructions, or any other data. Memory can further include a memory portion containing instructions for the processor to execute. Memory can may also be used as a working memory device for the processors or as a temporary storage.

In some embodiments, memory can be a non-transitory computer readable medium containing instructions that when executed by at least one processing unit (e.g., processor 403) cause a computing environment to perform a method or set of operations. Non-transitory computer readable mediums may be any medium capable of storing data in any memory in a way that may be read by any computing device with a processor to carry out methods or any other instructions stored in the memory. The non-transitory computer readable medium may be implemented to include any combination of software, firmware, and hardware. Software may preferably be implemented as an application program tangibly embodied on a program storage unit or computer readable medium consisting of parts, or of certain devices or a combination of devices. The application program may be uploaded to, and executed by, a machine comprising any suitable architecture. In at least one embodiment, a non-transitory computer readable medium includes a software program that includes instructions to perform operations that cause a computer or process to generate control signals or perform operations.

Figure 5:
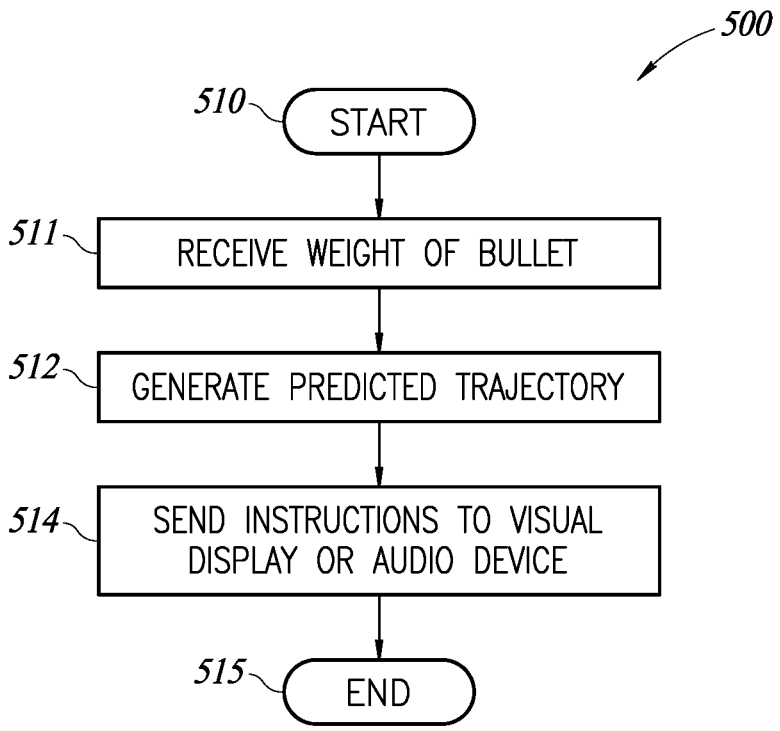
FIG. 5 illustrates a process flow diagram for adjusting aim of a user, in accordance with at least one embodiment.

FIG. 5 illustrates a process flow diagram for adjusting aim of a user, in accordance with at least one embodiment. Computer, system, processor, or combination thereof can perform process 500 to generate instructions to instructions for a shooter that indicate how to modify the aim of the gun based on the weight of the bullet. A computer, person, shooter, or operation can start process 500 at start step 510 (e.g., by turning on a computer, opening up a mobile application that assists users in aiming their gun).

At operation 511, a computing device receives weight of a bullet. For example, weight of a projectile is input to a user interface, such as by a scale, and the measurement is provided to a processor (e.g., CPU, GPU, ASIC, FPGA). For example, a mobile phone performing a mobile application (also referred to as an "app") can receive a log of weight of a projectile, previous outcomes, and/or predicted future trajectories. As another example, a manufacturer fires a gun at a manufacturing site, in a laboratory, and/or other controlled location such that variables (e.g., wind, gun type, gun properties, distance to target, size of target) are calculated to create weight profiles and/or identifying information such that it may be input into an application prior to firing a shot to predict a trajectory for a distance.

At operation 512, a computing device and the processor uses measurements of weight to generate a predicted trajectory of a projectile. A projectile's predicted trajectory may be predicted gathering measurements, such as by a rifle in a vise being fired to gather information, and storing said measurements for a neural network to correlate weight and bullet trajectory. The outcome may then indicate to a neural network a predicted grouping based, at least in part, on the weight (e.g., grain and/or grams) of the projectile. For example, a difference in weight may indicate that projectiles above an 80th percentile (e.g., 58.8 grams) are likely to have irregularities such as excess material from the manufacturer, such that their use may be avoided.

At operation 512, a computing device generates a trajectory for a projectile based, at least in part, on a weight of projectile. For example, a computing device may also have been set for a weight of a projectile at which sighting of a rifle occurred, such that any deviations between projectile weights may indicate to generate instructions to adjust sights for the weight difference. If a computing device determines that no instructions are recommended (e.g., gun is sighted for the projectile at the target), a computing device can continue to provide information (e.g., or generate additional instructions) using environmental conditions (e.g., wind, moisture, correct distance calculations attributing for altitude, and/or temperature), rifle information (e.g., barrel temperature, barrel information, manufacturer information), and/or biometrics (e.g., heart rate, shot approach, and/or breathing).

At send instructions operation 514, a computing device or other device can send instructions to visual display or audio device. For example, a mobile phone can send instructions to user's headphones that indicate how a user should adjust their aim based on the weight of the projectile. As another example, a mobile phone displays instructions on its user interface that indicate how a shooter should adjust their aim. As another example, as shown in FIG. 1, glasses can display information for a shooter to indicate to a user projectile weights best suited for a rifle's performance over a distance.

After operation 514, process 500 can end at operation 515. In at least one embodiment, process 500 can be repeated, partially repeated, or modified. For example, process 500 can be repeated for a different gun, a different shot (e.g., shot 10), a different time of day, different manufactured projectiles, different charges, and/or different weights.

Figure 6:
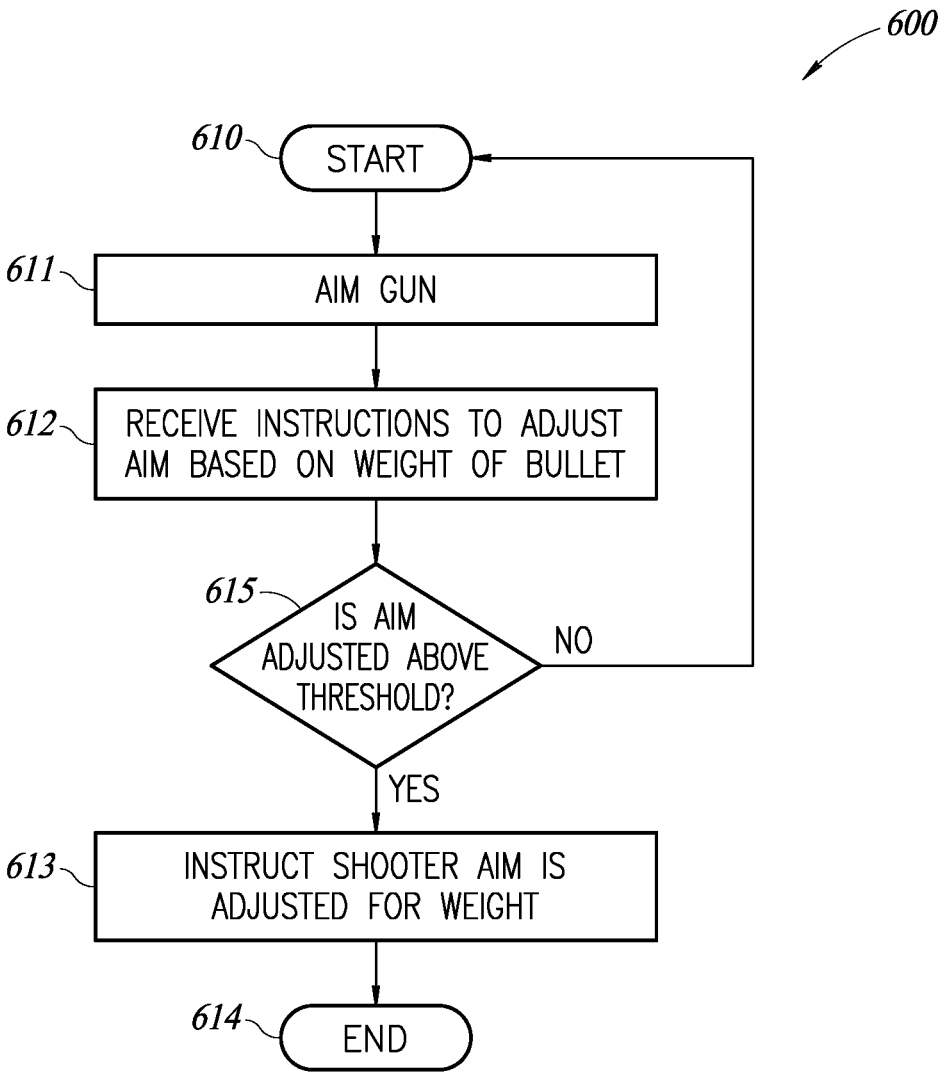
FIG. 6 another process flow diagram for adjusting aim of a user, in accordance with at least one embodiment.

FIG. 6 is another process flow diagram for adjusting aim of a user, in accordance with at least one embodiment. Computer, system, processor, or combination thereof can perform process 600 to generate instructions for a shooter that indicate how to modify the aim of the gun based on weight of a bullet. A computer, person, shooter, or operation can start process 600 at step 610 (e.g., by turning on a computer, opening up a mobile application that assists users in aiming their gun).

At operation 611, a gun may be aimed at a target, where aiming at a target indicates to begin a process. Target may be analyzed for distance and environmental conditions (e.g., wind, moisture, correct distance calculations attributing for altitude, and/or temperature), generating information.

At operation 612, a processor may receive instructions to generate a prediction of how to adjust aim based, at least in part, on a weight of a projectile. A processor may use a neural network, which can use projectile weight to indicate if a deviation to surface area of a projectile (e.g., manufacture defect) has occurred. Projectile weight may also be categorized in percentiles for a type of round and generate a prediction of a projectile's probability of error based, at least in part, on a projectile's percentile.

At decision operation 615, a decision is "NO," if an adjustment (e.g., to sights) does not sufficiently align with a desired target, not being adjusted above a sufficient threshold. To determine whether sights were adjusted correctly, a sensor may send information to a computing device and/or a camera visually determines whether sights are aligned with target (e.g., looking through sight and/or a number of adjustments made to sight by MOA). If a decision is "YES," a computing device may then proceed to operation 613.

At operation 613, a computing device instructs a shooter to aim based, at least in part, on an adjustment for a projectile weight. As an example, the generated instructions are based, at least in part, on a projectile weight and/or additional information. Additional information may include previous fired projectile outcomes, equipment information (e.g., barrel temperature, cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing).

After operation 613, process 600 can end at operation 614. In at least one embodiment, process 600 can be repeated, partially repeated, or modified. For example, process 600 can be repeated for a different gun, a different shot (e.g., shot 10), a different time of day, different manufactured projectiles, different charges, and/or different weights.

Figure 7:
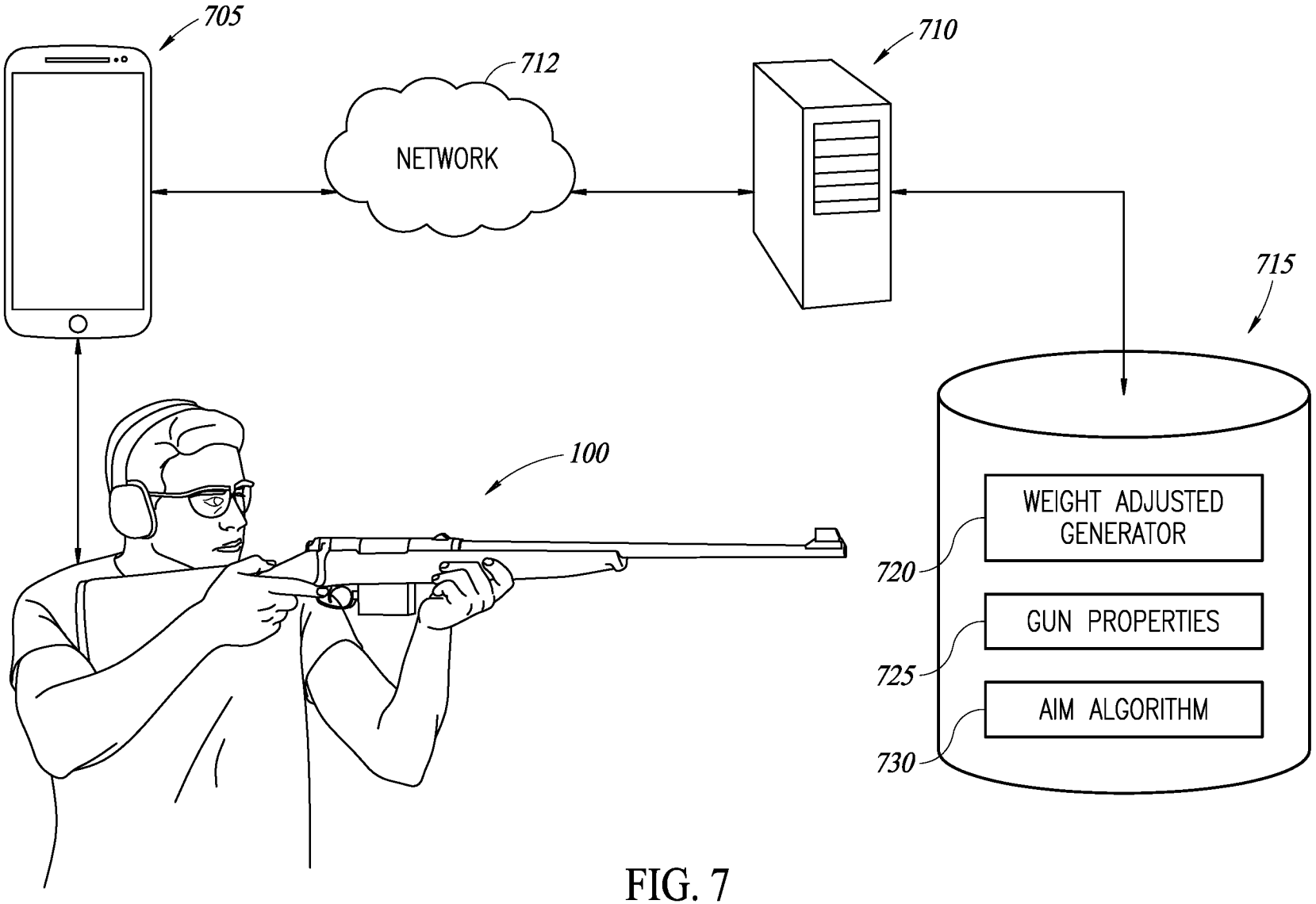
FIG. 7 illustrates a schematic block diagram including a system for adjusting aim of a projectile based, at least in part, on weight of a bullet, in accordance with at least one embodiment.

FIG. 7 illustrates a schematic block diagram including a system for adjusting aim of a projectile based, at least in part, on weight of a bullet, in accordance with at least one embodiment. FIG. 7 can be included in FIGS. 1-6, (e.g., components in FIG. 7) and can perform processes 500 and 600 disclosed in FIGS. 5 and 6, respectively. FIG. 7 can include software and hardware disclosed in FIGS. 1-3 (e.g., computing device 404 can be mobile computing device 705).

FIG. 7 includes components and objects from shooting environment 100. FIG. 7 also includes mobile computing device 705, network 712, server 710, and database 715. In at least one embodiment, a shooter from shooting environment 100 can connect to their mobile computing device 705 to receive information about how to adjust their aim of a projectile based, at least in part on a weight. Weight may act as an indication of a probability of error (e.g., distribution of shots).

Database 715 includes software for performing operations. Database 715 can be accessible over a network 712. Network 712 can be wireless communication network such as a Wi-Fi network, a network that follows Institute of Electrical and Electronics Engineers (IEEE) 802.11 standards for wireless communication, or a 3rd Generation Partnership Project (3GPP) standard such $3^{rd}$ generation (3G), $4^{th}$ generation (4G), $5^{th}$ generation (5G), or sixth generation (6G). In at least one embodiment, temperature profile generator 720, gun properties 725, and aim algorithm 730 are a combination of neural networks. A neural network can include a convolution neural network (e.g., receives temperature readings as inputs and outputs instructions for adjusting aim based on input), a diffusion network, recurrent neural network, a long short-term memory network, a gated recurrent unit network, an autoencoder, a generative adversarial network, transform network, or a combination thereof. For example, input such as barrel temperature, gun type, shooter information, environmental conditions, number of shots, and time between shots can be provided to neural networks weight adjusted generator 720, gun properties 725, and aim algorithm 730, and these neural networks can output instructions for adjusting aim of a gun.

Weight adjusted generator 720 may generate a profile for a projectile based, at least in part, on weight and projectile performance. Weight adjusted generator 720 may be a neural network to generate a data structure and/or table. Weight adjusted generator 720 is software, models, modules, and/or logic of a system, which includes a processor to perform weight adjusted generator 720. Weight adjusted generator 720 is a software stored in database 715. In at least one embodiment, weight adjusted generator 720 receives as input a measured weight of one or more projectiles and outputs a predicted trajectory based, at least in part, on the projectile's weight. Weight adjusted generator 720 may generate a prediction for a probability of error and/or trajectory of a projectile. For example, weight adjusted generator generates a prediction for a bullet's trajectory and a probability of error based at least in part on weight and other information. Other information includes a number and/or frequency of rounds fired, equipment information (e.g., barrel temperature, cartridge to include projectile size and/or amount of charge, manufacturer, rifle design), and/or environmental conditions (e.g., wind, moisture, correct distance calculations attributing for altitude, and/or temperature).

Gun properties 725 is a data structure, software, models, modules, and/or logic of a system, which a processor may use. Gun properties 725 is a software stored in database 715. Gun properties 725 may include equipment information. Equipment information includes a cartridge (e.g., projectile size and/or amount of charge), rifle design (e.g., weight, thickness, length, and/or diameter), trigger mechanics (e.g., stages of trigger used, weight of trigger, slack in trigger), and/or sight (e.g., amount of MOA per click rotation, such as ¼ MOA per ¼ turn "click," distance sighted in for, previous sight adjustments).

In at least one embodiment, aim algorithm 730 is a neural network. Aim algorithm 730 is a data structure, software, models, modules, and/or logic of a system, which a processor may use. Aim algorithm 730 is software stored in database 715. Aim algorithm 730 may include using a projectile's weight to predict the projectile's trajectory based, at least in part, on the trajectory of previous weight's trajectory and predicted error. For example, an aim algorithm 730, may predict a trajectory based, at least in part, on a predicted ballistic coefficient for a round, weight, distance to target, equipment information (e.g., cartridge to include projectile size and/or amount of charge, manufacturer, rifle design), prior outcomes of a shot, and/or environmental conditions (e.g., wind, moisture, correct distance calculations attributing for altitude, and/or temperature) for a projectile of a particular weight. Aim algorithm 730 may then generate instructions (e.g., to adjust aim and/or sights) to a marksman.

In at least one embodiment, a system for generating training data to determine how projectile weight affects bullet trajectory can be used (e.g., labeled data of bullet weight, results of shooting a bullet such as target and hit location, distance between gun barrel and target location, and environmental conditions). For example, the disclosed technology can include electronic target systems utilize sensors in a target or along the bullet's path to detect the impact point, including relaying this information in real-time to a computer or display. As an another example, systems to generate training data can include optical scopes with graduated reticles that allow marksmen and observers to note the aim point at the moment of the shot, while high-speed cameras can capture the bullet's trajectory and impact point in detail. As another example, systems to generate training data can include laser boresights project a dot indicating where the barrel is pointing, aiding in aiming verification. As another example, systems to generate training data can include impact markers on targets, such as special coatings that change color upon bullet impact, provide a visual cue of the hit location. As another example, systems to generate training data can include a spotter with a high-powered scope who can observe and guide the shooter, while ballistic software and mobile apps predict the bullet's path based on various inputs. As another example, systems to generate training data can include radar and acoustic systems that track the bullet's flight and impact. In at least one embodiment, data from these systems can be labeled and combined with projectile weight information to generate training data for neural networks.

Any of the computer-executable instructions stored in computing environment 200 for implementing the disclosed techniques as well as any data created and used during implementation of the disclosed embodiments may be stored on one or more computer-readable media (e.g., non-transitory computer-readable media). The computer-executable instructions may be part of, for example, a dedicated software application or a software application that is accessed or downloaded via a web browser or other software application (such as a remote computing application or gaming app). Such software may be executed, for example, on a single local computer or in a network environment (e.g., via the internet, a wide-area network, a local-area network, a client-server network (such as a cloud computing network), or other such network) using one or more network computers. For example, an app may be downloaded to a mobile device (such as a mobile phone, smart phone, tablet computer, or wearable computer) from an "app store" and installed locally on the computing environment 200. The app may be configured to interact with a platform server or a remote server in order to exchange information or account information and may be configured to provide instructions using projectile information to include a projectile's weight.

What is claimed is:

1. A non-transitory computer-readable medium storing instructions, which when executed by one or more processors, cause the one or more processors to: receive, from a digital scale, a first measured mass of a first bullet and a second measured mass of a second bullet, the first and second bullets to be of a same bullet type; determine a first ballistic coefficient for the first bullet and a second ballistic coefficient for the second bullet based, at least in part, on the respective measured masses, wherein the first ballistic coefficient and the second ballistic coefficient are to be different; compute a first aiming adjustment for firing the first bullet toward a target and a second aiming adjustment for firing the second bullet toward the target, wherein the first and second aiming adjustments differ based, at least in part, on the first and second ballistic coefficients; and provide, to a user device, first and second instructions that indicate how to modify an aim of a firearm based, at least in part, on the first aiming adjustment and the second aiming adjustment.

2. The non-transitory computer-readable medium of claim 1, wherein the non-transitory computer-readable medium further stores instructions, which when executed by the one or more processors, cause the one or more processors to use one or more neural networks to compute the first and second aiming adjustments.

3. The non-transitory computer-readable medium of claim 1, wherein computing the first and second ballistic coefficients are based, at least in part, on the same bullet type.

4. The non-transitory computer-readable medium of claim 1, wherein the non-transitory computer-readable medium further stores instructions, which when executed by the one or more processors, is to further cause the one or more processors to determine the first ballistics coefficient for the first bullet and the second ballistics coefficient for the second bullet using a correlation table, wherein the correlation table is based, at least in part, on firing the same type of bullet where the bullets have a distribution of weights.

5. The non-transitory computer-readable medium of claim 1, wherein the user device is at least one of the following: headphones, a mobile device, an earpiece, glasses, or a speaker.

6. The non-transitory computer-readable medium of claim 1, wherein to determine the adjustment further includes to determine a distribution of weight for the first bullet and the second bullet based, at least in part, on the measured masses and images of the first and second bullets.

7. The non-transitory computer-readable medium of claim 1, wherein the first and second aiming adjustments are information to perform a minute of angle (MOA) adjustment.

8. A system, comprising: one or more processors; memory to store instructions, which when executed by the one or more processors, cause the one or more processors to: store measured weights of a plurality of projectiles of a same type; store data including results corresponding to firing the plurality of projectiles at a target; generate a model to correlate the weight of the plurality of projectiles to ballistic coefficients based, at least in part, on the results corresponding to firing the plurality of projectiles at the target; receive measured weights of a first projectile and a second projectile to be fired, wherein the first and second projectiles are of the same type and have different measured weights; and generate a first expected trajectory for the first projectile and a second expected trajectory for the second projectile based, at least in part, on the measured weights of the first and second projectiles and the model, wherein the first and second expected trajectories are different.

9. The system of claim 8, wherein the memory to store instructions, which when executed by the one or more processors, further cause the one or more processors to: provide one or more instructions that indicate an aim adjustment based, at least in part, on the first expected trajectory for the first projectile and the second expected trajectory for the second projectile.

10. The system of claim 8, wherein the memory to store instructions, which when executed by the one or more processors, further cause the one or more processors to: receive information ambient conditions corresponding to where the first and second projectiles are to be fired; and adjust the first and second trajectories based, at least in part, on the ambient conditions.

11. The system of claim 8, wherein the measured weights are based, at least in part, on one or more signals received from a digital scale.

12. The system of claim 8, wherein the model includes one or more neural networks.

13. The system of claim 8, wherein the memory to store instructions, which when executed by the one or more processors, further cause the one or more processors to: measure the weight of the first and second projectiles based, at least in part, on receiving one or more images of the first and second projectiles.

14. The system of claim 8, wherein the memory to store instructions, which when executed by the one or more processors, further cause the one or more processors to: generate instructions to adjust sights based, at least in part, on the first expected trajectory and the second expected trajectory.

15. A method comprising: determining weights of a first bullet and a second bullet, wherein the weight of the first bullet differs from the weight of the second bullet; determining a first ballistic coefficient for the first bullet and a second ballistic coefficient for the second bullet based, at least in part, on the first bullet weight and the second bullet weight, wherein the first ballistic coefficient differs from the second ballistic coefficient; and providing instructions that indicate different aiming adjustments for firing the first bullet and the second bullet, the different aiming adjustments based, at least in part, on the first and second ballistic coefficients.

16. The method of claim 15, wherein the determining the weights includes receiving a signal from a digital scale.

17. The method of claim 15, wherein the determining the weights includes using one or more neural networks to generate an estimated measured weight of the first and second bullets based, at least in part, on one or more images of the first and second bullets.

18. The method of claim 15, wherein the determining the first and second ballistic coefficients includes using a correlation table that correlates bullet weights and ballistic coefficients.

19. The method of claim 15, wherein providing instructions is further based, at least in part, on a temperature measurement of a barrel used to fire the first and second bullets.

20. The method of claim 15, further comprising: displaying the instructions to a user.

21. The method of claim 15, wherein the instructions include audio or visual information for a marksman.

* * * * *